US005744901A

United States Patent [19]

Friederichs et al.

[11] Patent Number: 5,744,901

[45] Date of Patent: Apr. 28, 1998

[54] ELECTRIC REFLECTOR LAMP

[75] Inventors: Winand H.A.M. Friederichs, Bath, N.Y.; Hubertus J. Muller, Eindhoven, Netherlands

[73] Assignee: U.S. Philips Corporation, New York, N.Y.

[21] Appl. No.: 705,571

[22] Filed: Aug. 29, 1996

[30] Foreign Application Priority Data

Aug. 30, 1995 [EP] European Pat. Off. ..... 95202341.4

[51] Int. Cl.[6] ..... H01K 1/48; H01J 5/48

[52] U.S. Cl. ..... 313/113; 313/318.01; 313/318.11; 439/617; 362/226

[58] Field of Search ..... 73/113, 318.01, 73/318.09, 318.1, 318.11, 25; 439/611, 617, 618; 362/226

[56] References Cited

U.S. PATENT DOCUMENTS

| | | | |
|---|---|---|---|
| 3,885,185 | 5/1975 | Tilley | 313/318.1 |
| 4,119,877 | 10/1978 | Grewe et al. | 313/318 |
| 4,404,491 | 9/1983 | Siaens et al. | 313/318.1 |
| 5,199,787 | 4/1993 | King et al. | 362/310 |
| 5,216,319 | 6/1993 | Van Heeswijk | 313/318 |
| 5,281,889 | 1/1994 | Fields et al. | 313/113 |
| 5,294,863 | 3/1994 | Geboers et al. | 313/113 |
| 5,367,219 | 11/1994 | Friederichs | 313/113 |
| 5,381,070 | 1/1995 | Tuttle et al. | 313/318.01 |
| 5,504,392 | 4/1996 | Natour et al. | 313/570 |
| 5,534,742 | 7/1996 | Krapp et al. | 313/113 |
| 5,556,191 | 9/1996 | Maassen | 362/256 |

FOREIGN PATENT DOCUMENTS

| | | |
|---|---|---|
| 952005080 | 4/1995 | European Pat. Off. . |
| 952005635 | 6/1995 | European Pat. Off. . |
| 952008423 | 7/1995 | European Pat. Off. . |

*Primary Examiner*—George M. Dombroske
*Assistant Examiner*—Harshad Patel
*Attorney, Agent, or Firm*—Walter M. Egbert

[57] ABSTRACT

The electric reflector lamp has a reflector body with a neck. A lamp vessel containing an electric element is secured in the reflector body, held by a mounting member which has a securing portion. A lamp base is secured around the neck. The mounting member has a circumferential wall which surrounds the neck and which has relief cooperating with relief of the neck so as to couple the circumferential wall to the neck. Elastic elements of the circumferential wall seize in the recesses in the ceramic lamp base so as to secure the base. The reflector lamp is readily assembled using a small number of components.

18 Claims, 5 Drawing Sheets

ELECTRIC REFLECTOR LAMP

BACKGROUND OF THE INVENTION

The invention relates to an electric reflector lamp comprising:

a glass reflector body with a concave reflecting portion, a neck, and an optical axis;

a light-transmitting lamp vessel accommodating an electric element and fixed in the reflector body, the electric element being arranged in the reflecting portion;

a metal mounting member with a retaining portion which securely holds the lamp vessel;

a lamp cap with electric contacts which is fixed around the neck;

current conductors extending from the electric element to the contacts of the lamp cap.

Such an electric reflector lamp is known from U.S. Pat. No. 5,367,219.

The mounting member in the known lamp has the shape of a plate and has an opening alongside which resilient tags are arranged. A portion of the lamp vessel is passed through the opening and is held tightly clamped by the tags. The mounting member bears on projections in the neck in axial direction. The current conductors are clamped tautly tensioned in metal bushes and fastened to a transverse wall of the neck. A metal lamp cap is fixed in that it is indented into cavities in the outer surface of the neck. A cover, a glass plate or a lens, closes off the reflector body. This cover cannot be provided until after the lamp vessel has been mounted because the lamp vessel is introduced through the light emission opening to be closed off by the cover and is fastened, for example, with cement or glass enamel. The number of components to be joined together after or during the assembly of the lamp vessel with the reflector body is comparatively great. The application and curing of cement or glass enamel in a separate process step may be disadvantageous if volatile ingredients are released during this which can escape from the closed or substantially closed reflector body with difficulty only.

An electric reflector lamp closed with a glass plate or lens is known from U.S. Pat. No. 5,281,889, where the neck of the reflector body consists of two parts and the mounting member is enclosed between these two parts. The lamp vessel of this lamp was introduced into the reflector body through the neck, but the parts of the neck were subsequently fastened to one another with an adhesive.

A special lens for an electric reflector lamp is known from U.S. Pat. No. 5,199,787.

An application of earlier date WO 95/24 586-A1 (PHN 14.762) describes a reflector lamp in which the reflecting surface is paraboloidally curved adjacent the neck while remote from the neck it is a body of revolution of a parabola branch pivoted with respect to the optical axis.

An application of earlier date WO 96/07 193-A1 (PHN 14.978) describes an electric reflector lamp of the kind described in the opening paragraph in which a ceramic body is present in the neck around the lamp vessel, which causes the temperature of the lamp vessel in situ to be lower during operation.

An application of earlier date EP 95 200 508.0 (PHN 15.215) describes an electric reflector lamp in which a plate is clamped around the lamp vessel in the neck, which has prevented the cement with which the lamp vessel is fixed in the neck from flowing all around the lamp vessel.

An application of earlier date EP 95 200 563.5 (PHN 15.231) describes an electric reflector lamp in which axial lanes are superimposed on the concave reflecting portion.

An application of earlier date EP 95 200 842.3 (PHN 15.270) describes an electric reflector lamp of the kind mentioned in the opening paragraph in which the mounting member is a metal bush which is accommodated in the neck, which has an opening with clamping tags in its bottom, which extends towards the reflecting surface, and which bears with an edge thereon. The neck of the reflector body is as a result substantially closed off from the space within the reflecting portion.

An application of earlier date EP 0627 759-A1 (PHN 14.481) describes an electric discharge lamp whose lamp vessel is fixed in a ceramic lamp cap by means of cement. Ceramic lamp caps have the advantage that they can be used at high operational temperatures. It is a disadvantage, however, that they have to be mounted with cement, which renders the assembling operation time-consuming.

A capped discharge lamp is known from U.S. Pat. No. 5,216,319 where a metal sleeve grips around the lamp vessel with clamping action, so that retaining means of the lamp cap can grip this sleeve.

A capped incandescent lamp is known from U.S. Pat. No. 4,119,877 where the pinch seal of the lamp vessel projects through an opening of a metal plate, while resilient tags are arranged along said opening which hold the pinch seal with clamping action. The lamp cap is fastened to this metal plate.

SUMMARY OF THE INVENTION

It is an object of the invention to provide an electric reflector lamp of the kind described in the opening paragraph which has a construction which renders the lamp easy to assemble.

According to the invention, this object is achieved in that the retaining portion of the mounting member comprises a circumferential wall which surrounds the neck and has a relief which cooperates with a relief of the neck such that the circumferential wall and the neck are mutually coupled, and the lamp cap surrounds the mounting member closely so as to lock the coupling between the circumferential wall and the neck, while the lamp cap is coupled to the circumferential wall.

Since the mounting member surrounds the neck of the reflector body, the lamp vessel and the mounting member are joined together with the reflector body from the rear of the reflector body, i.e. the side where the lamp cap will be mounted, during the assembly of the reflector lamp. If the reflector lamp has a cover, a glass plate or lens, which closes off the light emission window of the lamp, the reflector body with the cover fastened thereto may be supplied to the assembling position as one unit, and an assembly step or a fastening process for interconnecting said two components afterwards is avoided.

The retaining portion of the mounting member may be, for example, a sleeve which grips around the lamp vessel, for example around a seal, a pinch seal or a fused seal. A plate having an opening through which the lamp vessel projects and along which resilient tags are arranged which securely hold the lamp vessel has proved to be an excellent retaining member or retaining portion in many lamp types, among them reflector lamps. The lamp vessel may be united with the mounting member in that the lamp vessel is introduced into this member.

The relief of the mounting member provides a coupling between the mounting member and the neck because it cooperates with a relief of the neck. The relief on the neck may comprise one or several projections over which the mounting member grips. It is favorable, however, because of a greater simplicity of molds in which the reflector body can be formed, when the relief of the neck comprises one or several recesses in the neck. These may be obtained in that the reflector body is locally indented immediately after leaving the mold. The circumferential wall of the mounting member may be indented after being applied around the neck so as to obtain a relief which grips into the relief, i.e. the recesses, of the neck in order to couple the mounting member and the neck together. However, a favorable embodiment is one in which the relief is present on an elastic portion of the circumferential wall of the mounting member. The mounting member may then be simply united with the reflector body in that it is snapped home thereon. The mounting member may for this purpose have, for example, resilient tags at, for example cut from, the circumferential wall, which tags are provided each with a projecting portion, for example a fold, by way of relief.

The lamp cap now narrowly surrounds the mounting member so that the relief of this member does not lose its grip on the relief of the neck. The lamp cap may be coupled to the mounting member, for example, by means of a soldered joint, or in particular by means of a welded joint, for example a laser weld.

It is favorable when the lamp cap is made of synthetic resin material, for example polyether imide, sulfone or sulfide, for use of the reflector lamp at comparatively high voltages, or of ceramic material, for example steatite, for use at comparatively high temperatures. The lamp cap may then be coupled to the circumferential wall, for example with an adhesive, for example cement. It is favorable, however, when the lamp cap has an internal recess into which an elastic element of the circumferential wall grips with locking action. The elastic element may be, for example, a tongue cut out from the circumferential wall. The gripping portion of such a tongue may be, for example, a hook, for example if the tongue extends away from the reflecting portion, or, for example, the free end of the tongue if the tongue extends towards the reflecting portion. This latter modification has the advantage that it is of a simple shape and that it is oriented along with the translation direction of the lamp cap during capping.

It is favorable when the lamp cap and the circumferential wall each have two or more such recesses and elastic elements, distributed over their respective circumferences.

In a special embodiment, the elastic portion is constructed as a cluster of two or more tongues with gripping portions which are axially differently placed. This embodiment renders possible a rigid coupling of the lamp cap to the circumferential wall in spite of dimensional differences which may occur among bodies of one type, especially ceramic bodies.

The assembly of the reflector lamp is particularly easy. The unit of the lamp vessel and mounting member may be simply joined together with the reflector body, which may previously have been provided with a cover. The lamp cap is passed over the neck. The assembly of the lamp is then complete, except for a possible lock which the lamp cap may need, and which may be made, for example, by welding or soldering.

It may be favorable when the neck and the mounting member as well as the mounting member and the lamp cap have cooperating profiles such as, for example, axially extending grooves and projections which hamper a mutual rotation.

It may be favorable when the mounting member is constructed from several parts and has a first part which comprises the retaining member and a second part which comprises the circumferential wall. These parts may cooperate telescopically and, for example, may be fastened together with welds. This embodiment is favorable when the location of the electric element in the lamp vessel is insufficiently accurately defined for obtaining a good light beam if all units of a type are held by the mounting member in the same location of the lamp vessel.

It is advantageous when the reflector body has an abutment for the mounting member transverse to the axis. The axial position of the mounting member is well-defined then. The mounting member may have, for example, a projecting rim which bears on said abutment and which is narrowly enclosed between said abutment and the lamp cap.

The electric element of the reflector lamp may be an incandescent body, for example in a gas containing halogen, or a pair of electrodes in an ionizable gas which comprises, for example, metal halide. The electric element may possibly be accommodated in a light-transmitting inner envelope made of, for example, glass, such as quartz glass, or of ceramic material.

The lamp vessel may be made of glass, for example hard glass or glass having an $SiO_2$ content of at least 96% by weight. Alternatively, the lamp vessel may be made of ceramic material, polycrystalline or monocrystalline, for example alumina.

The reflector body may have various shapes and may or may not have superimposed facets or lanes. It may be reflectorized with a metal layer or with a dichroic mirror.

The lamp cap may, for example, be threaded, be of the bayonet-type, and may have contact surfaces or, for example, contact pins.

BRIEF DESCRIPTION OF THE DRAWINGS

An embodiment of the reflector lamp according to the invention is shown in the drawing, in which.

DESCRIPTION OF THE PREFERRED EMBODIMENTS

Figure 1:
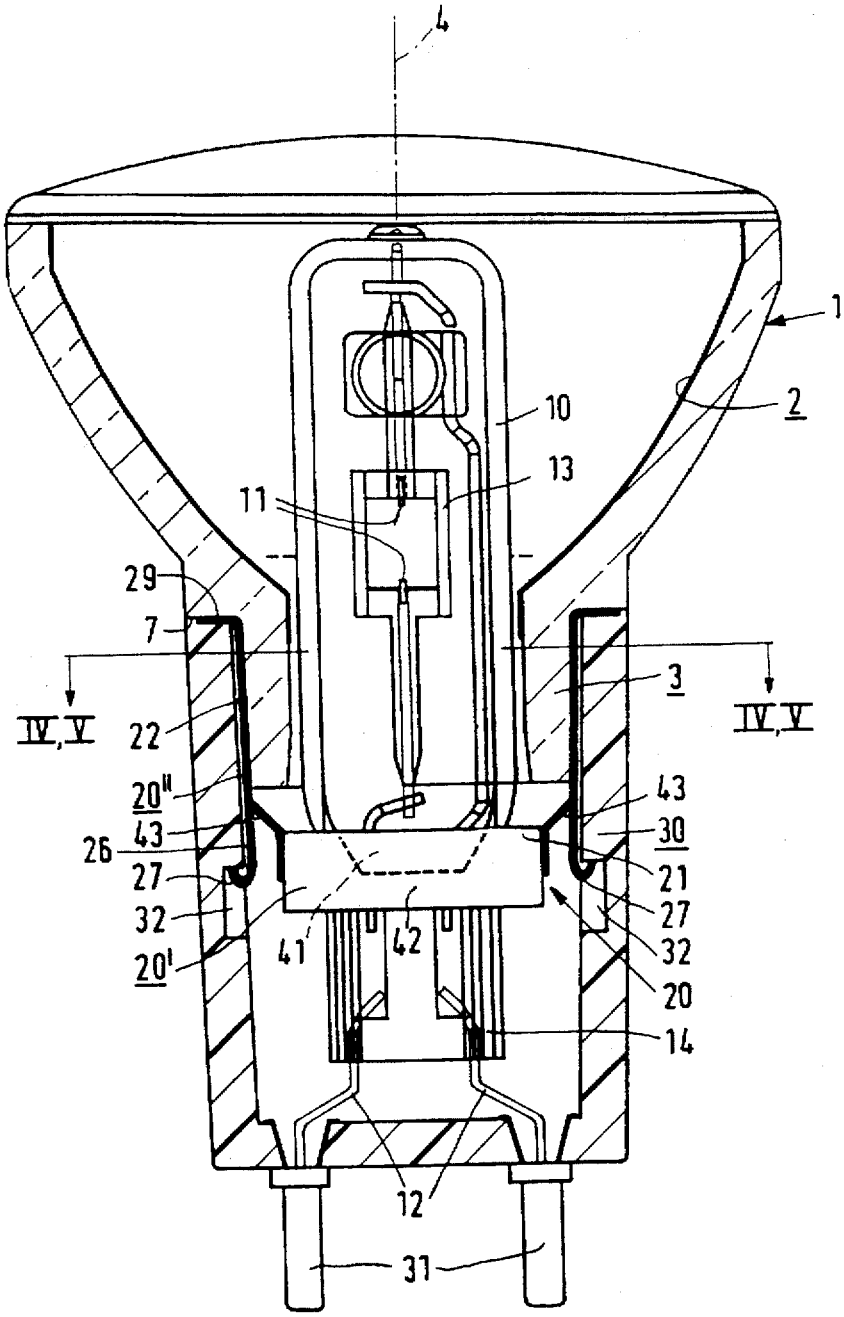
FIG. 1 is an axial sectional view of a reflector lamp.

The electric reflector lamp of FIG. 1 has a glass reflector body 1 with a concave reflecting portion 2 which has a metal coating. The reflector body has a neck 3 and an optical axis 4. A light-transmitting quartz glass lamp vessel 10 is fixed in the reflector body 1, and an electric element 11, a pair of electrodes arranged in an inner ceramic envelope 13 filled with ionizable gas, is present inside said lamp vessel. The electric element is in the reflecting portion 2. The ionizable gas comprises metal halides, a rare gas, and possibly mercury. The lamp has a metal mounting member 20 with a retaining portion 21 which securely holds the lamp vessel 10. A lamp cap 30 with electric contacts 31 is fixed around the neck 3. Current conductors 12 extend from the electric element 11 to the contacts 31 of the lamp cap 30.

The retaining portion 21 of the mounting member 20 comprises a circumferential wall 22 which surrounds the neck 3 and has a relief 23 (see FIGS. 2, 3) which cooperates with a relief 5 on the neck (see FIG. 4), such that the circumferential wall 22 and the neck 3 are mutually coupled. The lamp cap 30 surrounds the mounting member 20 narrowly so as to lock the coupling between the circumferential wall 22 and the neck 3. The lamp cap 30 is coupled to the circumferential wall 22.

The lamp vessel 10 has a pinch seal 14 through which the current conductors 12 issue from the lamp vessel to the exterior. The retaining portion 21 has resilient tags 41 (see also FIGS. 2, 3) which securely hold the pinch seal.

The reflector body 1 has an abutment 7 for the mounting member 20 transverse to the axis 4.

The mounting member 20 has a projecting rim 29 which bears on the abutment 7 and is enclosed between the abutment and the lamp cap 30.

The mounting member 20 of FIG. 1 consists of more than one part, having a first part 20' which comprises the retaining portion 21 and a second part 20" which comprises the circumferential wall 22. The first part 20' has a cylindrically flanged rim 42 at the retaining portion 21. The second part 20" has welding lugs 43 at the circumferential wall 22. The welding lugs 43 were welded to the rim 42 after the electric element 11 was brought into a previously defined position relative to the projecting rim 29, and thus to the abutment 7, and accordingly to the reflecting portion 2.

The lamp cap 30 is made of ceramic material and has an internal recess 32 into which an elastic element 26 of the circumferential wall 22 grips with locking action. The elastic element drawn is a tongue which extends away from the reflecting portion and which has a hook as the gripping portion 27.

Figure 2:
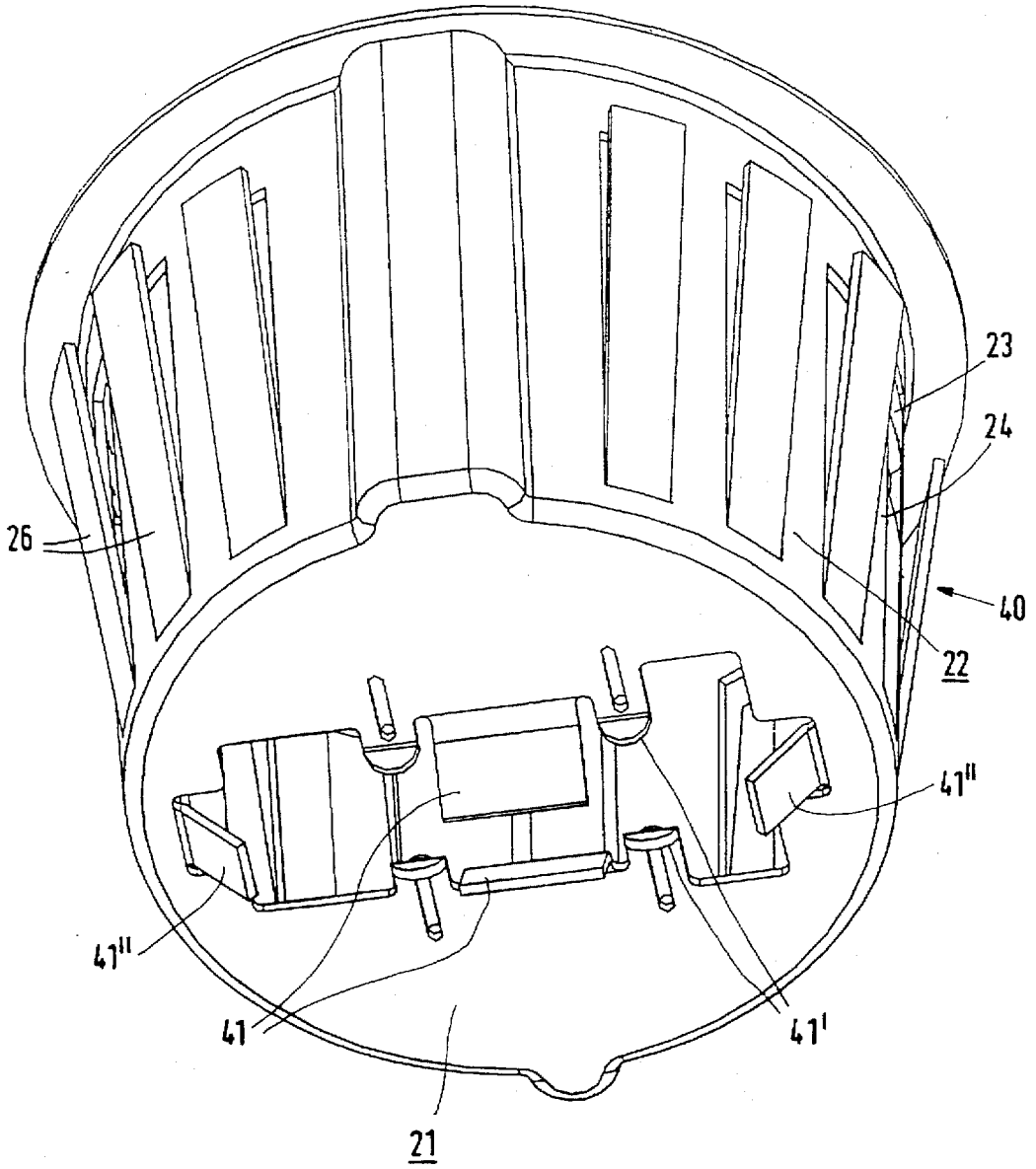
FIGS. 2 and 3 show a modification of the mounting member of FIG. 1 in perspective view.
Figure 3:
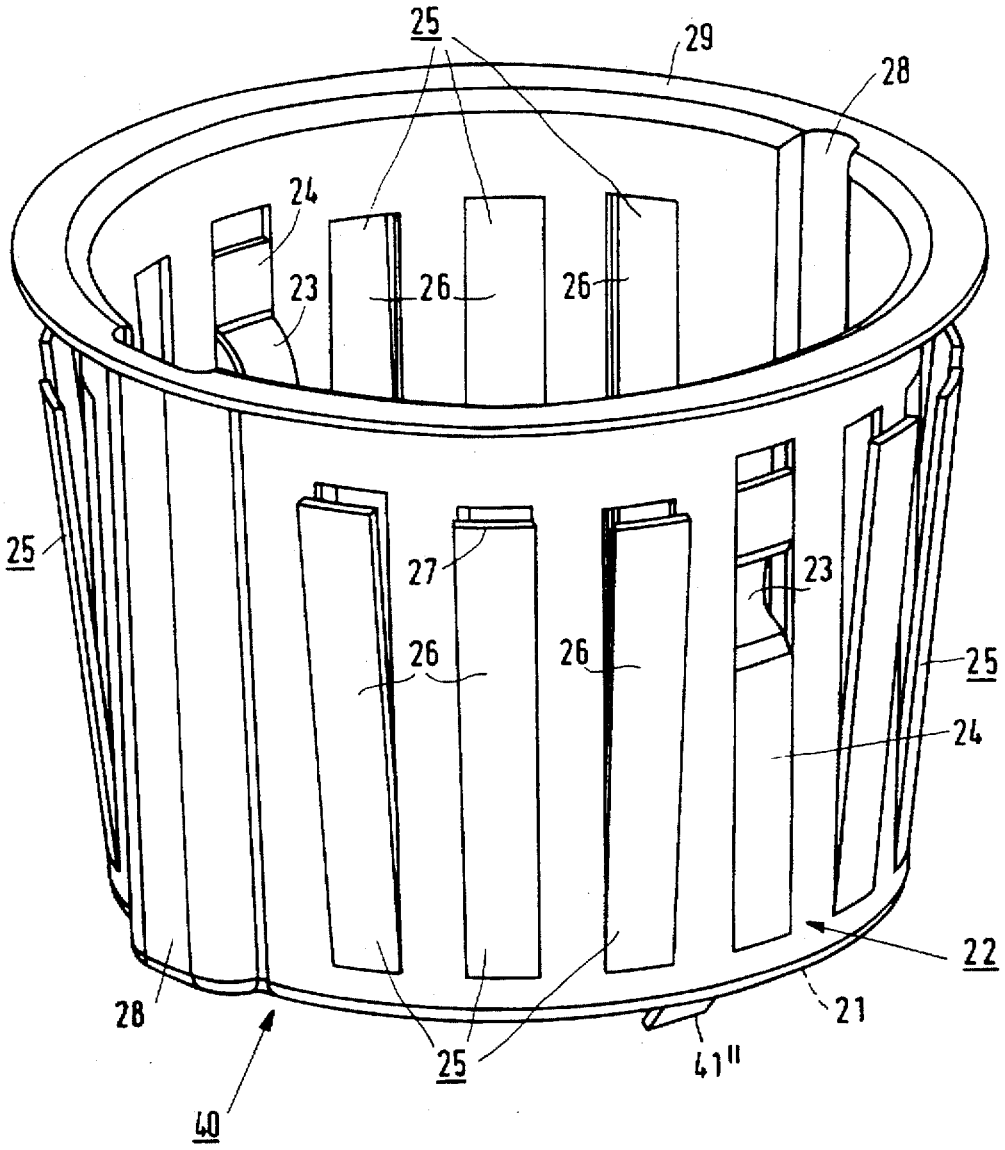

In FIGS. 2 and 3, parts of the mounting member 40 corresponding to parts of the mounting member 20 of FIG. 1 have the same reference numerals. The circumferential wall 22 is integral with the retaining portion 21. The mounting member shown was obtained through deep-drawing and cutting. The retaining portion 21 is plate-shaped and has an opening along which resilient tags 41 are arranged which are capable of securely gripping a pinch seal 14 (FIG. 1) which projects through the opening. Smaller tags 41' on either side and transverse tags 41" also contribute to this. The integral mounting member 40 is useful if the position of the electric element in the lamp vessel is already accurately defined, or if this position is not very critical.

The relief 23 on the circumferential wall 22 capable of cooperating with the relief 5 in the neck 3 of the reflector body is present on an elastic portion 24 of the wall 22, on resilient tongues in the Fig. The embodiment shown has two such elastic portions 24, but there may be more or even only one in modified versions. The relief 23 is a projecting portion facing the neck 3, a fold in the Fig. After being placed around a neck of a reflector body, the folds are deformed by the lamp cap when it is passed over the neck. The abutment 7 (see FIG. 1) and the rim 29, however, keep the mounting member 40 axially positioned during this.

After the circumferential wall 22 has been mounted around a reflector body 1 (FIG. 1), it has an elastic element 26, a tongue in FIGS. 2 and 3, which is directed towards the reflecting portion 2.

The mounting member 40 has a cluster 25 of elastic elements 26 with free ends as the gripping portions 27 which are positioned in different axial locations. In FIG. 2, the tongue on the left extends to closer to the projecting rim in the portion of the circumferential wall 22 facing the observer than does the tongue on the right, and even the central tongue, also compare FIG. 3. When the lamp cap 30 is provided (FIG. 1), the tongues which are directed in the translation direction of the lamp cap will move resiliently inwards and, the moment the recess 32 in the lamp cap has reached the relevant free tongue end, will spring back outwards and grip into the recess, thus locking the lamp cap. Should the recess be closer to the projecting rim 29 as a result of manufacturing tolerances, the longer or even also the longest tongue will spring into the recess. The recess 32 may be a circumferential groove. The embodiment drawn has four such clusters 25.

In the embodiment shown, the mounting member 40 has a profile 28, an axially extending projection, also see FIG. 3, which can cooperate at the outer surface with a profile in the lamp cap (see FIG. 5) and at the inner surface with a profile of the neck (see FIG. 4) so as to prevent mutual rotation. The profile at the outer surface may also serve to guide the elastic elements 26 towards the recess in the lamp cap. The embodiment shown has two such profiles, but of different widths. This is useful in lamps where the lamp vessel must be placed in the lamp cap in one rotational position only, for example, if the contacts of the lamp cap are not symmetrically arranged and the current conductors are bent accordingly.

Figure 4:
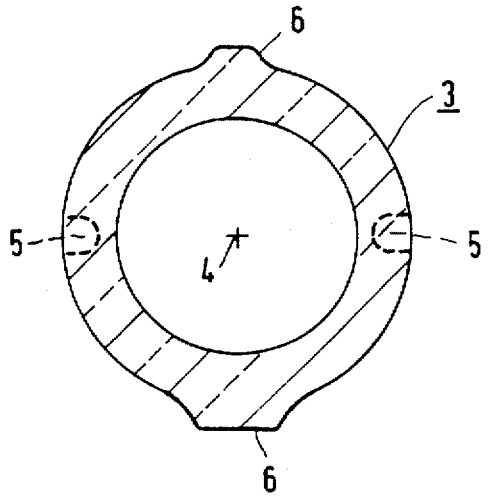
FIG. 4 is a cross-section of the neck taken on the line IV—IV in FIG. 1.
Figure 5:
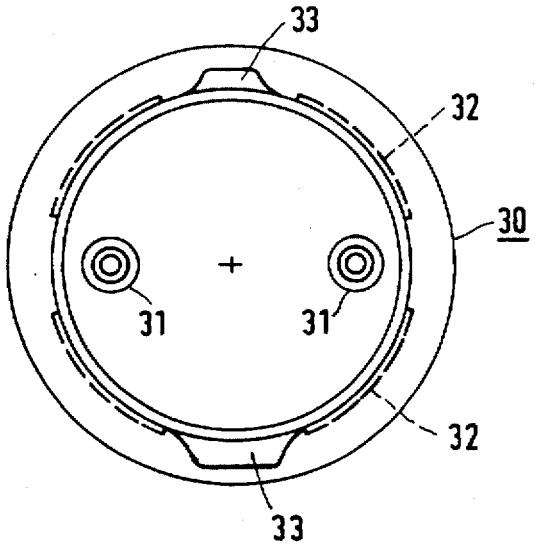
FIG. 5 is a cross-section of the lamp cap taken on the line V—V in FIG. 1.

It is apparent from FIG. 4 that the neck 3 has a profile which matches the shape of the profile 28 of the mounting member 40 and which can cooperate therewith. It is equally apparent from FIG. 5 that the lamp cap 30 has a profile 33 which cooperates with the profile 28 of the mounting member 40. Mutual rotations of lamp cap, mounting member, and neck are hampered thereby.

Figure 6:
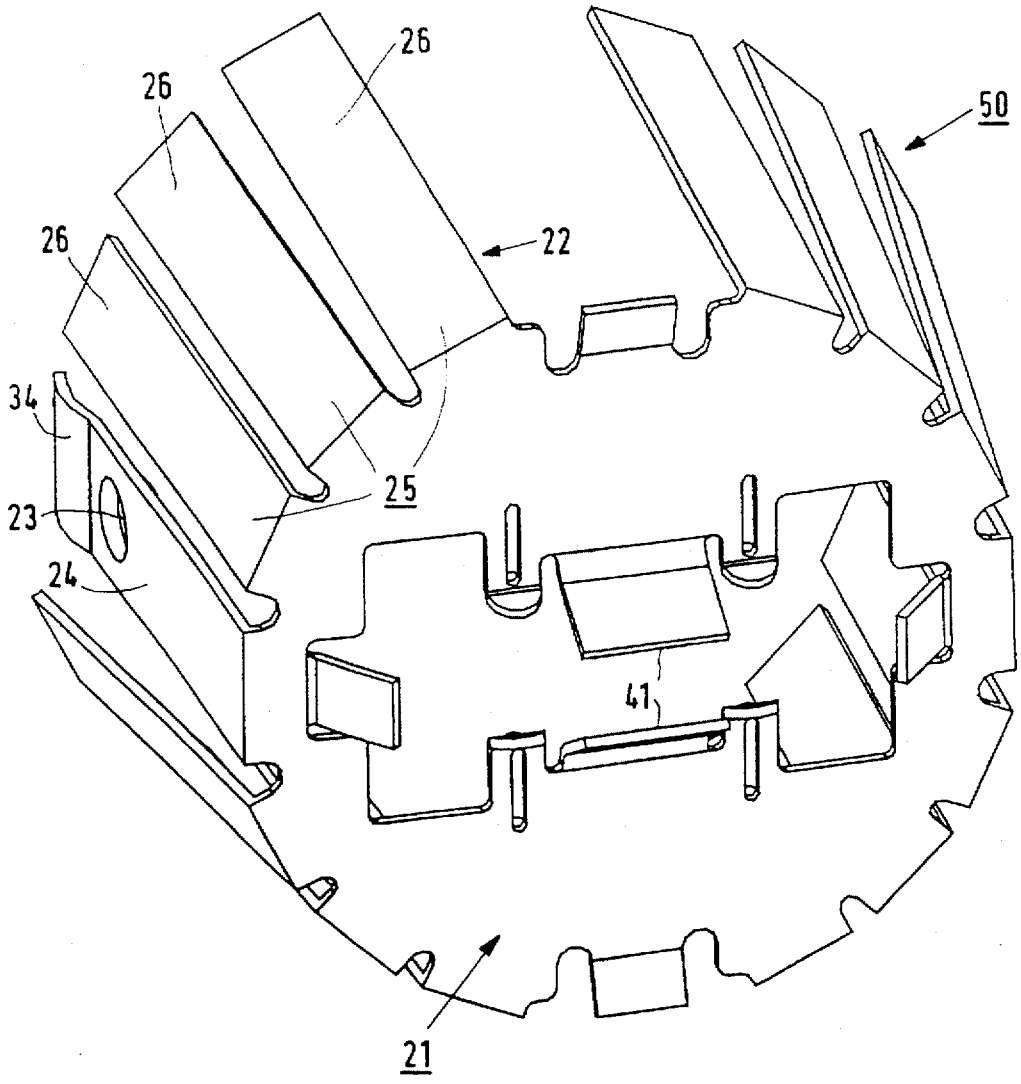
FIG. 6 shows a further modification of the mounting member in perspective view.

The mounting member 50 of FIG. 6, in which parts corresponding to parts of FIG. 2 or 3 have the same reference numerals, is obtained by cutting and bending of a metal plate. The circumferential wall 22 has a large number of interruptions as a result. The relief 23 is a pressed-out bulge in an elastic portion 24 in the form of a tongue which at its free end has an outward fold 34 which can be engaged by the lamp cap to be mounted.

We claim:

1. An electric reflector lamp comprising:

a glass reflector body with a concave reflecting portion, a neck, and an optical axis;

a light-transmitting lamp vessel accommodating an electric element and fixed in the reflector body, the electric element being arranged in the reflecting portion;

a metal mounting member with a retaining portion which securely holds the lamp vessel;

a lamp cap with electric contacts which is fixed around the neck;

current conductors extending from the electric element to the contacts of the lamp cap, wherein the retaining portion of the mounting member comprises a circumferential wall which surrounds the neck and has a relief which cooperates with a relief of the neck such that the circumferential wall and the neck are mutually coupled, and the lamp cap surrounds the mounting member closely so as to lock a coupling between the circumferential wall and the neck, while the lamp cap is coupled to the circumferential wall.

2. An electric reflector lamp as claimed in claim 1, wherein the relief on the circumferential wall is present on an elastic portion thereof.

3. An electric reflector lamp as claimed in claim 2, wherein the relief on the circumferential wall comprises a bulge which is directed towards the neck.

4. An electric reflector lamp as claimed in claim 2, wherein the lamp cap is made from a material chosen from synthetic resin and ceramic material and internally has a recess into which an elastic element of the circumferential wall grips with locking action.

5. An electric reflector lamp as claimed in claim 4, wherein the elastic element is a tongue directed towards the reflecting portion.

6. An electric reflector lamp as claimed in claim 5, wherein the mounting member comprises a cluster of elastic elements with gripping portions which are situated in different axial locations.

7. An electric reflector lamp as claimed in claim 4, wherein the neck and the mounting member as well as the mounting member and the lamp cap have mutually cooperating profiles which hamper a mutual rotation.

8. An electric reflector lamp as claimed in claim 7, wherein the mounting member is made of more than one part and has a first part which comprises the retaining portion, which portion is fastened to a second part which comprises the circumferential wall.

9. An electric reflector lamp as claimed in claim 4, wherein the mounting member comprises a cluster of elastic elements with gripping portions which are situated in different axial locations.

10. An electric reflector lamp as claimed in claim 4, wherein the mounting member is made of more than one part and has a first part which comprises the retaining portion, which portion is fastened to a second part which comprises the circumferential wall.

11. An electric reflector lamp as claimed in claim 2, wherein the reflector body has an abutment stop for the mounting member transverse to the axis.

12. An electric reflector lamp as claimed in claim 11, wherein the mounting member has a projecting rim which bears on said abutment stop and is enclosed between said abutment stop and the lamp cap.

13. An electric reflector lamp as claimed in claim 2, wherein the neck and the mounting member as well as the mounting member and the lamp cap have mutually cooperating profiles which hamper a mutual rotation.

14. An electric reflector lamp as claimed in claim 2, wherein the mounting member is made of more than one part and has a first part which comprises the retaining portion, which portion is fastened to a second part which comprises the circumferential wall.

15. An electric reflector lamp as claimed in claim 1, wherein the lamp cap is made from a material chosen from synthetic resin and ceramic material and internally has a recess into which an elastic element of the circumferential wall grips with locking action.

16. An electric reflector lamp as claimed in claim 1, wherein the neck and the mounting member as well as the mounting member and the lamp cap have mutually cooperating profiles which hamper a mutual rotation.

17. An electric reflector lamp as claimed in claim 1, wherein the mounting member is made of more than one part and has a first part which comprises the retaining portion, which portion is fastened to a second part which comprises the circumferential wall.

18. An electric reflector lamp as claimed in claim 1, wherein the reflector body has an abutment stop for the mounting member transverse to the axis.

* * * * *